US010434639B1

(12) United States Patent
Chen et al.

(10) Patent No.: US 10,434,639 B1
(45) Date of Patent: Oct. 8, 2019

(54) CABINET HAVING CUSHIONED SIDE FRAMES

(71) Applicants: Kung-Cheng Chen, Taichung (TW); Lung-Chuan Huang, Taichung (TW)

(72) Inventors: Kung-Cheng Chen, Taichung (TW); Lung-Chuan Huang, Taichung (TW)

(73) Assignee: E-MAKE CO., LTD., Taichung (TW)

( * ) Notice: Subject to any disclaimer, the term of this patent is extended or adjusted under 35 U.S.C. 154(b) by 0 days.

(21) Appl. No.: 16/160,009

(22) Filed: Oct. 15, 2018

(30) Foreign Application Priority Data

Jun. 12, 2018 (TW) ..... 107207902 U

(51) Int. Cl.

| | |
|---|---|
| ***B25H 3/02*** | (2006.01) |
| ***B25H 3/04*** | (2006.01) |
| ***B25H 1/12*** | (2006.01) |
| *E05B 65/46* | (2017.01) |

(52) U.S. Cl.
CPC ..... *B25H 3/028* (2013.01); *B25H 1/12* (2013.01); *B25H 3/04* (2013.01); *E05B 65/46* (2013.01)

(58) Field of Classification Search
CPC .. B25H 3/04; B25H 3/028; B25H 1/12; E05B 65/46
USPC ..... 312/321.5, 265; 108/57.12; 211/126.1, 211/183, 189–191
See application file for complete search history.

(56) References Cited

U.S. PATENT DOCUMENTS

| | | | | |
|---|---|---|---|---|
| 6,484,472 | B2 * | 11/2002 | Chi | E04F 19/028 52/288.1 |
| 6,767,019 | B2 * | 7/2004 | van Hekken | B62B 3/006 108/147.12 |
| 6,945,615 | B1 * | 9/2005 | Cain | B25H 3/028 312/249.8 |
| 7,044,569 | B1 * | 5/2006 | Relyea | A47B 67/04 280/47.35 |
| 7,204,374 | B2 * | 4/2007 | Marek | B25H 3/04 211/70.6 |
| 8,157,337 | B2 * | 4/2012 | Manalang | B25H 3/06 312/249.8 |
| 2003/0141687 | A1 * | 7/2003 | Wixted | B62B 3/006 280/47.35 |
| 2004/0160150 | A1 * | 8/2004 | Hay | A47B 97/00 312/281 |

(Continued)

FOREIGN PATENT DOCUMENTS

| | | | | |
|---|---|---|---|---|
| DE | 202013104429 | U1 * | 1/2014 | B25H 1/12 |
| EP | 1532894 | A1 * | 5/2005 | B25H 3/00 |
| FR | 2971219 | A3 * | 8/2012 | B25H 1/12 |

*Primary Examiner* — Daniel J Troy
*Assistant Examiner* — Ryan A Doyle

(57) ABSTRACT

A cabinet is provided with drawers; two front corner posts; a rear panel; two side panels; a first side frame secured to one side panel and including two hollow corner posts attached to one front corner post and the rear panel respectively, a top bar interconnecting upper portions of the hollow corner posts, a bottom bar interconnecting lower portions of the hollow corner posts and secured to one side panel, a board disposed between the hollow corner posts, the top bar, and the bottom bar, and a push handle secured to both the top bar and on side panel; and a second side frame secured to the other side panel. Hand tools can be stored in the first and second side frame. The hollow corner posts are cushioned.

1 Claim, 8 Drawing Sheets

(56) References Cited

U.S. PATENT DOCUMENTS

| | | | | |
|---|---|---|---|---|
| 2005/0140106 | A1* | 6/2005 | Huguet | A47B 95/043 280/79.3 |
| 2009/0211933 | A1* | 8/2009 | Chen | B25H 3/02 206/373 |
| 2011/0187248 | A1* | 8/2011 | Kao | A47B 81/00 312/280 |
| 2012/0061930 | A1* | 3/2012 | Lin | B25H 3/02 280/47.35 |
| 2012/0085714 | A1* | 4/2012 | Johnson | A47B 55/02 211/41.1 |
| 2014/0217044 | A1* | 8/2014 | Cole | B25H 3/028 211/85.8 |
| 2014/0265440 | A1* | 9/2014 | Chen | B62B 5/0006 296/186.1 |
| 2015/0115786 | A1* | 4/2015 | Manalang | A47B 31/00 312/321.5 |

* cited by examiner

CABINET HAVING CUSHIONED SIDE FRAMES

BACKGROUND OF THE INVENTION

1. Field of the Invention

The invention relates to cabinets and more particularly to a cabinet having cushioned side frames, a rack, baskets or the like for storing or holding hand tools, etc.

2. Description of Related Art

Employees can be hurt when colliding with corners of a cabinet. Also, a wheeled cabinet may be damaged when it collides with a hard object while wheeling.

There is a conventional cabinet having pads on four corners. However, its cushioning effect is poor because the pads are not hollow. Further, no reinforcement is provided on the cabinet.

Furthermore, for a cabinet there are no additional racks or the like for holding or storing hand tools in addition to drawers.

Thus, the need for improvement still exists.

SUMMARY OF THE INVENTION

It is therefore one object of the invention to provide a cabinet comprising a containing structure including a plurality of drawers, two front corner posts, a rear panel, and two side panels; a first side frame made of aluminum and secured to one side panel, the first side frame including two hollow corner posts attached to one front corner post and the rear panel respectively, a top bar interconnecting upper portions of the hollow corner posts, a bottom bar interconnecting lower portions of the hollow corner posts and secured to one side panel, a board disposed between the hollow corner posts, the top bar, and the bottom bar, and a push handle secured to both the top bar and on side panel; and a second side frame made of aluminum and secured to the other side panel, the second side frame including two hollow corner posts attached to the other front corner post and the rear panel respectively, a top bar interconnecting upper portions of the hollow corner posts of the second side frame and secured to the other side panel, a bottom bar interconnecting lower portions of the hollow corner posts of the second side frame and secured to the other side panel, a rack secured to both the top bar of the second side frame and the other side panel, a plurality of sets of two positioning members secured to the corner posts of the second side frame respectively, and a plurality of baskets secured to the sets of the positioning members respectively.

The above and other objects, features and advantages of the invention will become apparent from the following detailed description taken with the accompanying drawings.

DETAILED DESCRIPTION OF THE INVENTION

Figure 1:
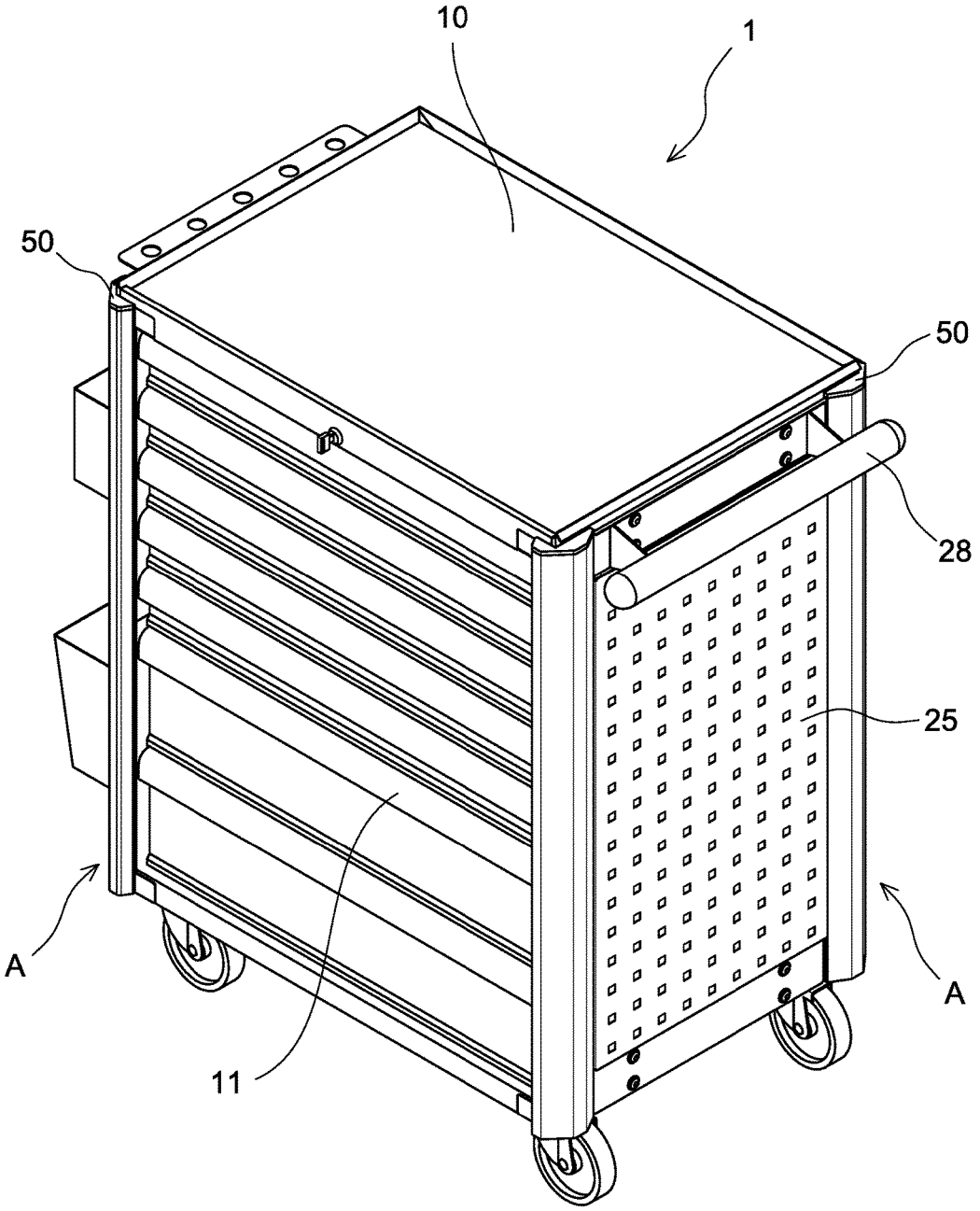
FIG. 1 is a perspective view of a cabinet according to the invention.
Figure 2:
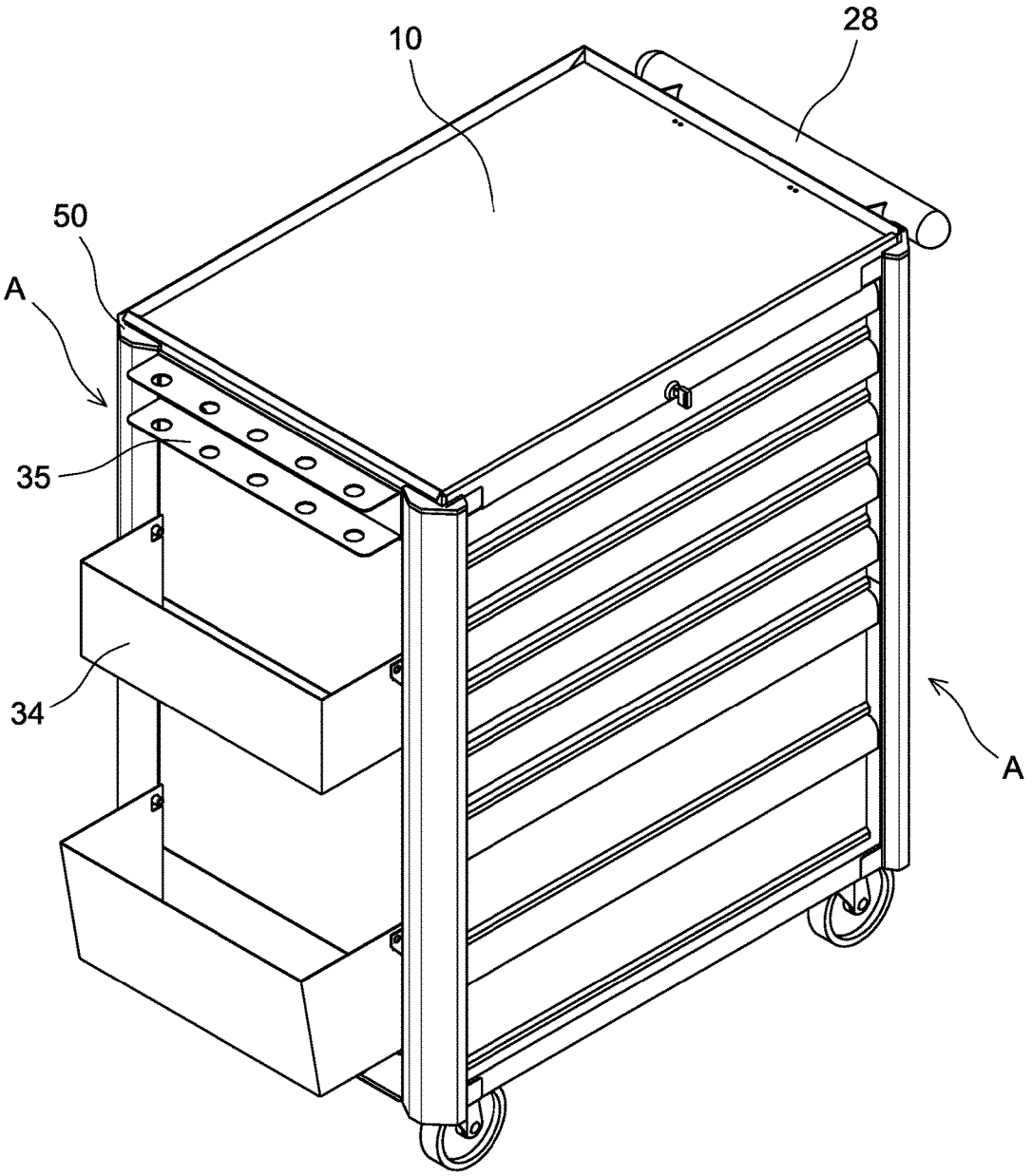
FIG. 2 is another perspective view of the cabinet.
Figure 3:
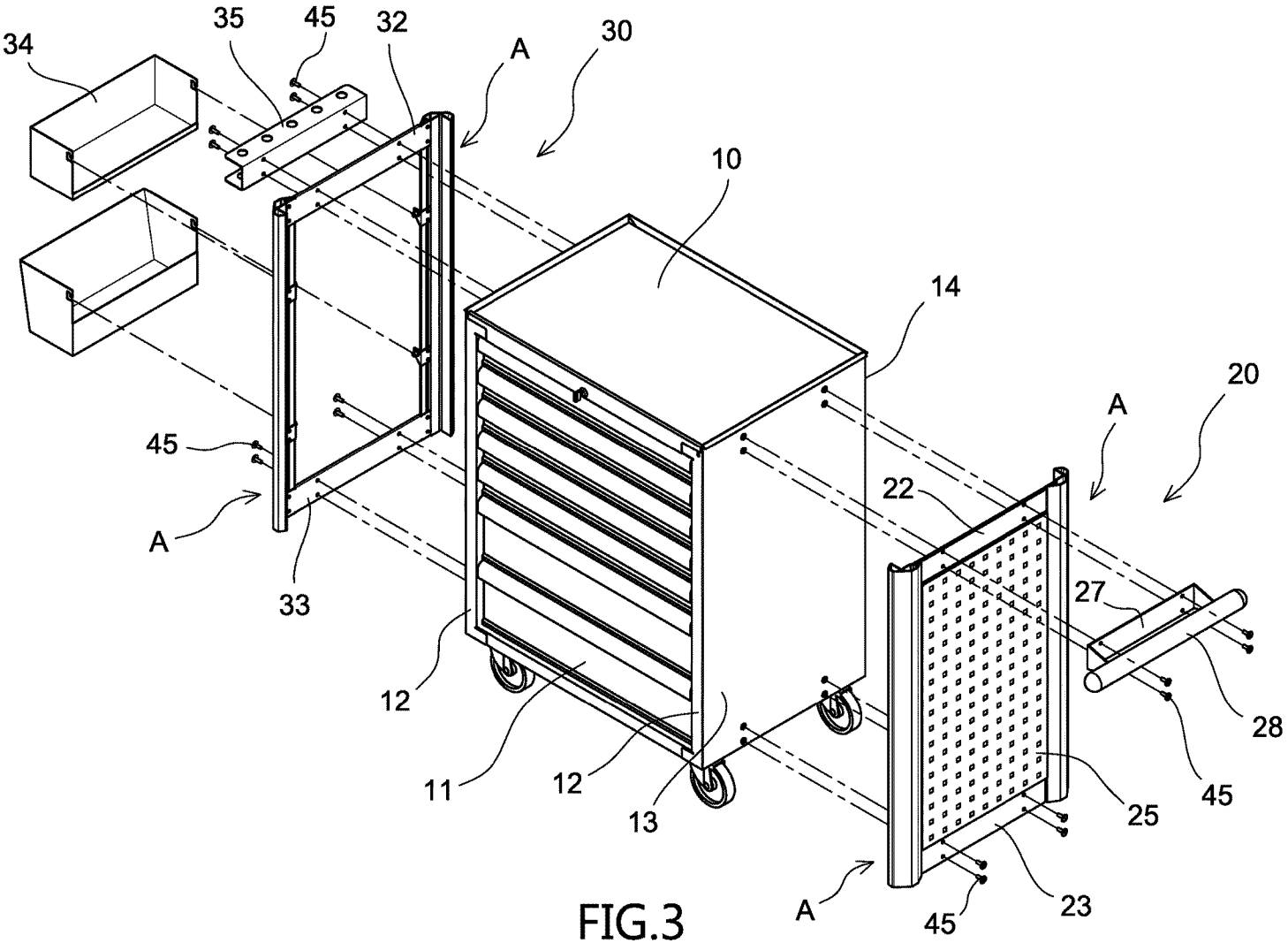
FIG. 3 is an exploded perspective view of the cabinet.
Figure 4:
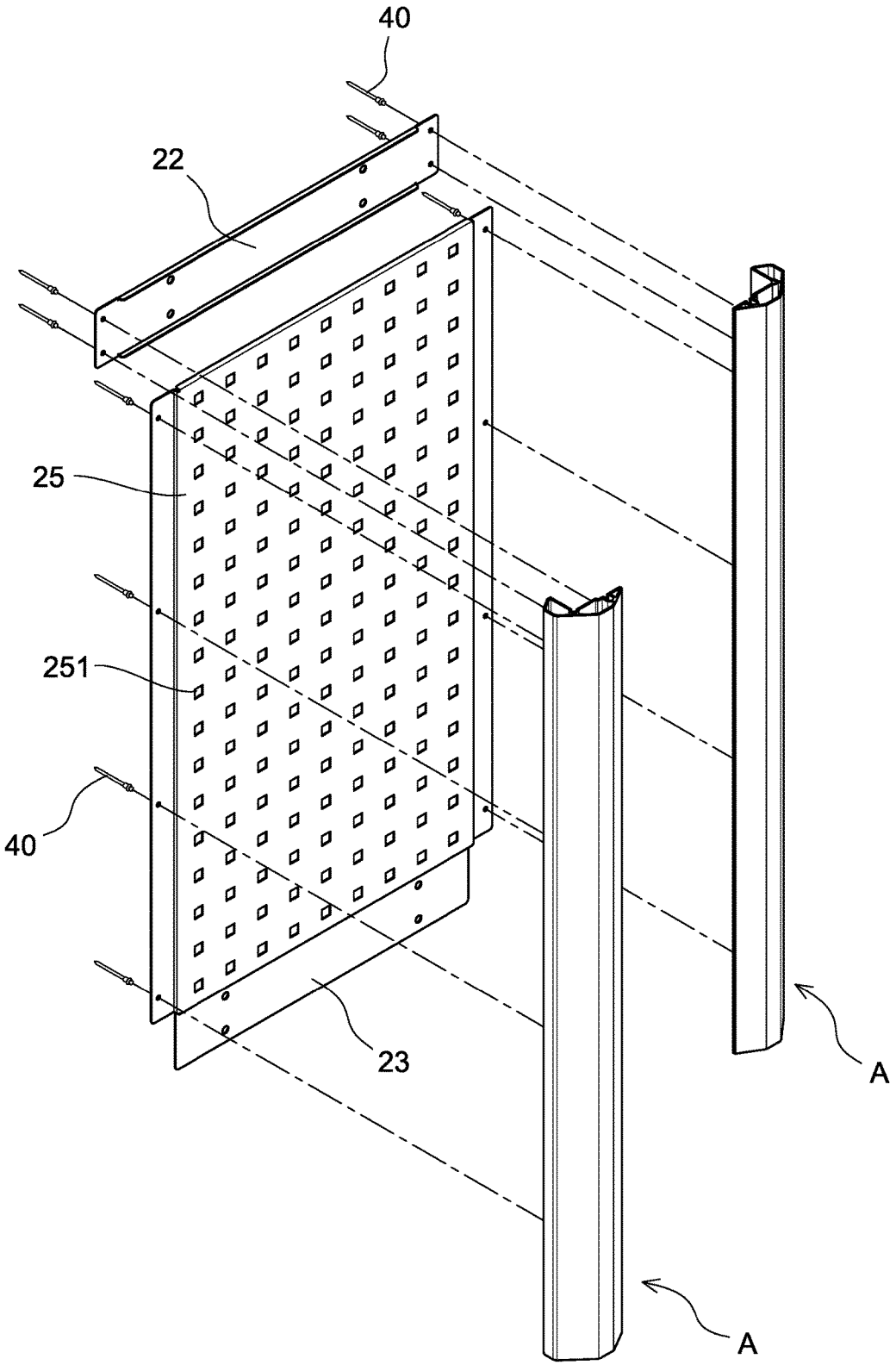
FIG. 4 is an exploded view of a main portion of the right side frame of the cabinet.
Figure 5:
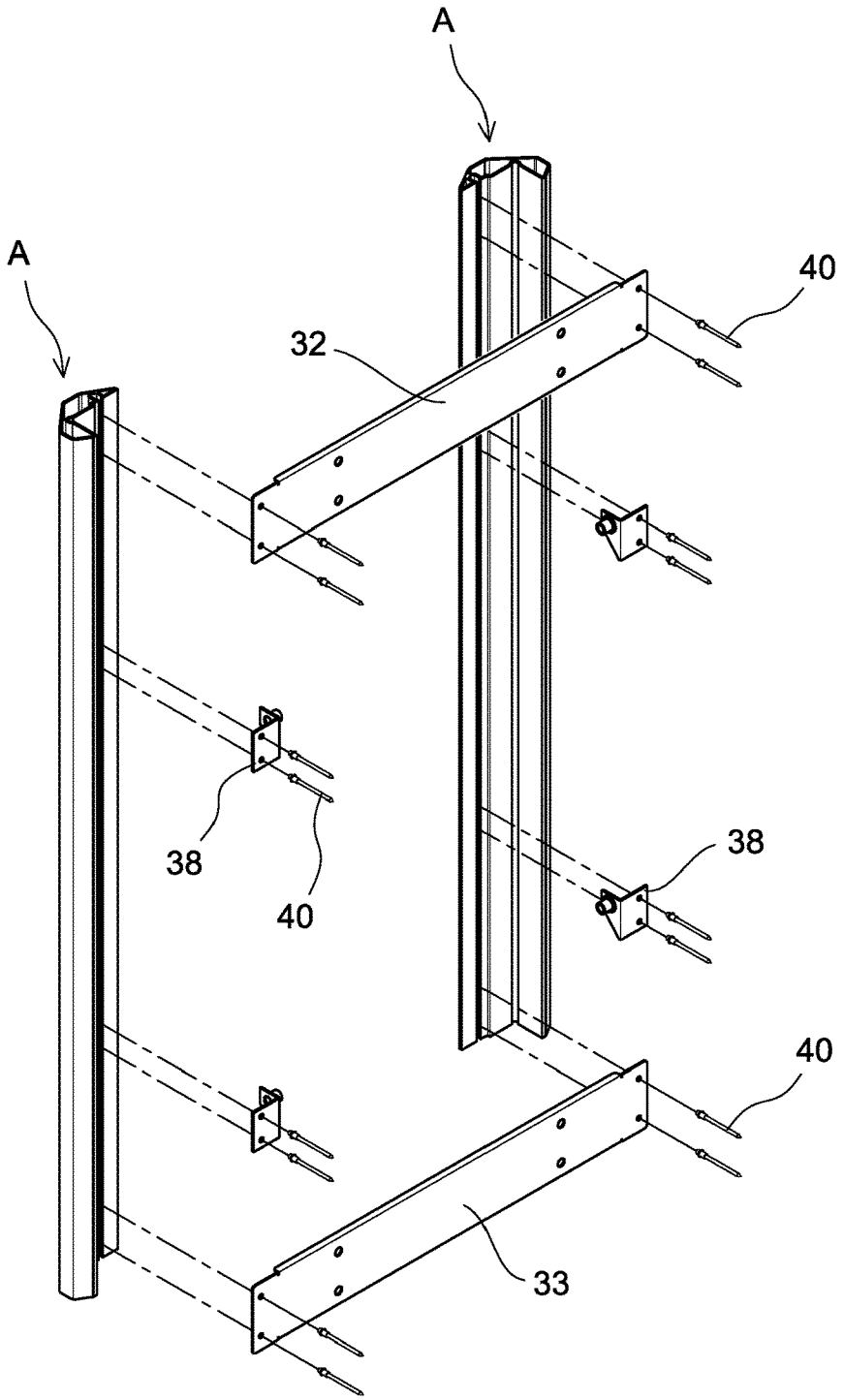
FIG. 5 is an exploded view of a main portion of the left side frame of the cabinet.
Figure 6:
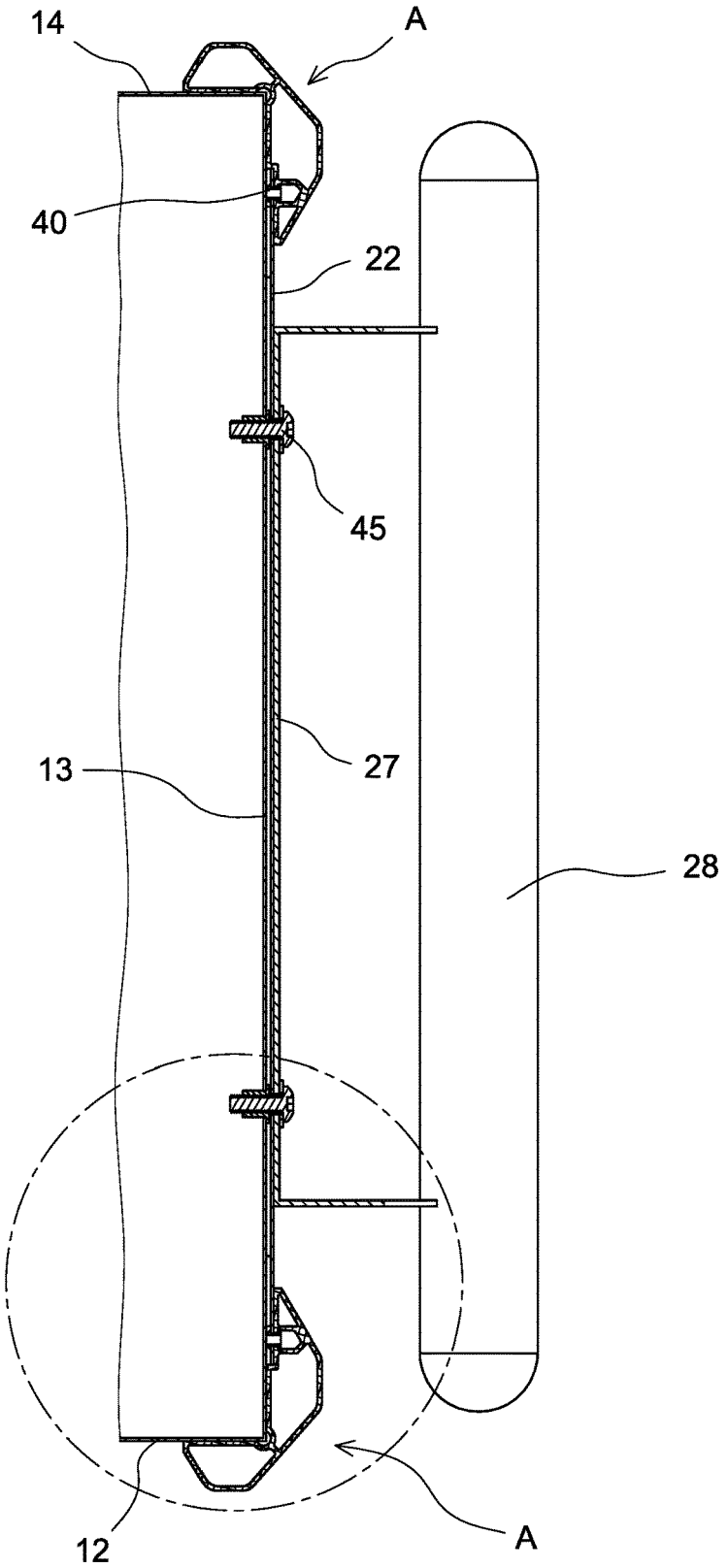
FIG. 6 is a top view in part section of the right portion of the cabinet of FIG. 1.
Figure 6A:
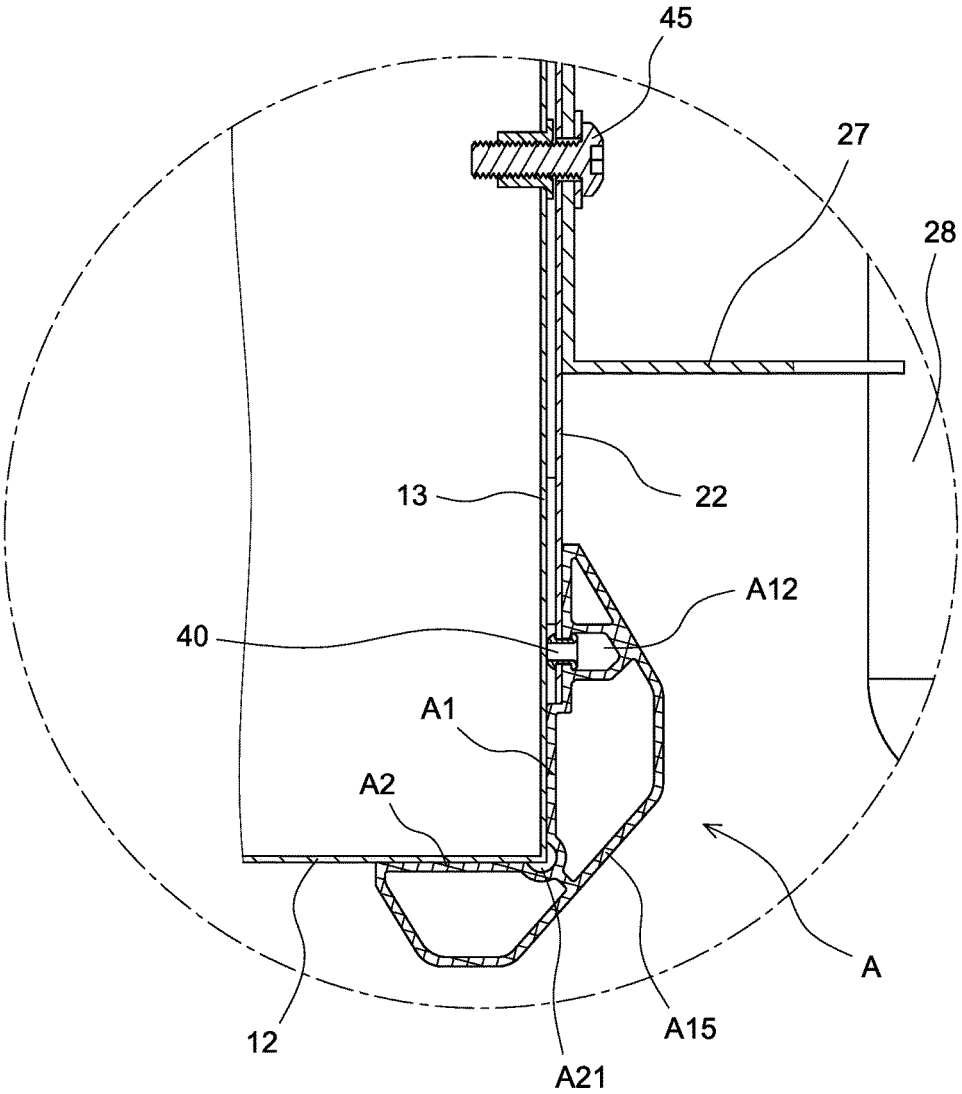
FIG. 6A is an enlarged view of a circle of FIG. 6.
Figure 7:
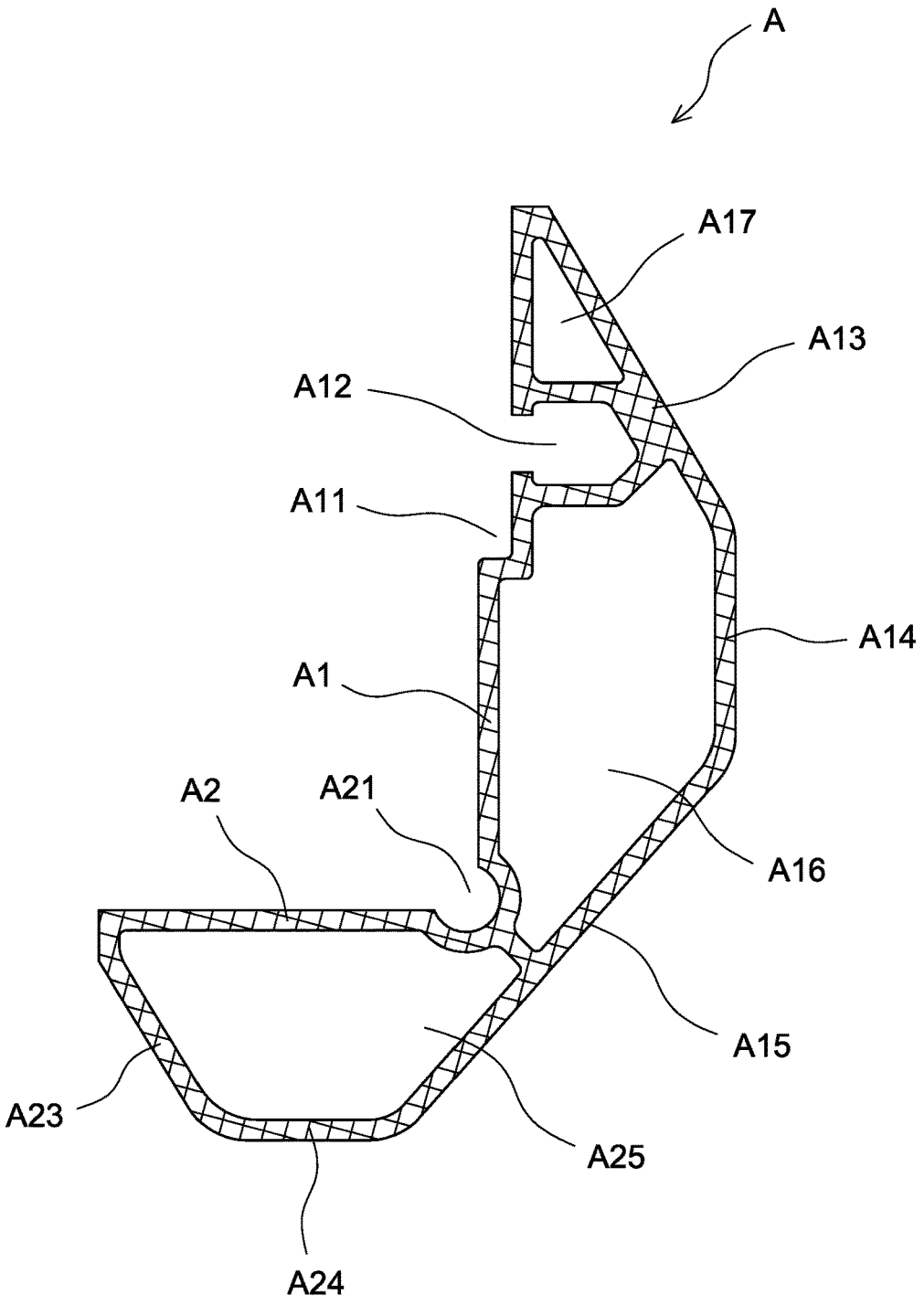
FIG. 7 is an enlarged view of the corner post of FIG. 6A.

Referring to FIGS. 1 to 7, a cabinet 1 in accordance with the invention comprises a containing structure 10 including a plurality of drawers 11, two front corner posts 12, a rear panel 14, and two side panels 13; a first side frame 20 made of aluminum and secured to one side panel 13, the first side frame 20 including two hollow corner posts A attached to one front corner post 12 and the rear panel 14 respectively, top of each corner post A being sealed by a cap 50, a top bar 22 interconnecting upper portions of the corner posts A, a bottom bar 23 interconnecting lower portions of the corner posts A and secured to one side panel 13 by driving first screws 45 through itself into one side panel 13, a board 25 having a plurality of holes 251, a mount 27 secured to one side panel 13 by driving first screws 45 through itself and the top bar 22 into one side panel 13, and a push handle 28 formed with the mount 27; a plurality of second screws 40 in which some are driven through the corner posts A and the top bar 22 to urge against one side panel 13, and some are driven through the corner posts A and the board 25 to urge against one side panel 13; a second side frame 30 made of aluminum and secured to the other side panel 13, the second side frame 30 including two hollow corner posts A attached to the other front corner post 12 and the rear panel 14 respectively, top of each corner post A being sealed by a cap 50, a top bar 32 interconnecting upper portions of the corner posts A of the second side frame 30 and secured to the other side panel 13 by driving a plurality of second screws 40 through the corner post A of the second side frame 30 and itself to urge against the other side panel 13, a bottom bar 33 interconnecting lower portions of the corner posts A of the second side frame 30 and secured to the other side panel 13 by driving a plurality of first screws 45 through itself and the other side panel 13 and driving a plurality of second screws 40 through the corner posts A of the second side frame 30 and the bottom bar 33 to urge against the other side panel 13, a rack 35 secured to both the top bar 32 and the other side panel 13 by driving a plurality of first screws 45 through itself and the top bar 32 into the other side panel 13, two sets of two positioning members 38 secured to the corner posts A of the second side frame 30 respectively by driving a plurality of second screws 40 through the corner posts A of the second side frame 30 into the sets of the positioning members 38, and two baskets 34 secured to the sets of the positioning members 38 respectively.

It is envisaged by the invention that hand tools can be stored in the baskets 34, screwdrivers or the like can be stored in the rack 35, and wrenches or the like can hanged from steel rods fastened in the holes 251; and an employee may hold the push handle 28 to move the cabinet 1.

The corner post A includes a first inner surface A1 abutted on either side panel 13, a second inner surface A2 perpendicular to the first inner surface A1 and abutted on either one of the front corner posts 12 or the rear panel 14, a C-shaped groove A21 at a joining portion of the first inner surface A1 and the second inner surface A2 and complimentarily engaged with one of four corners of the containing structure 10, a shoulder A11 at an end of the inner surface A1 distal the C-shaped groove A21 and engaged with an end of one of the top bar 22, the top bar 32, the bottom bar 23, and the bottom bar 33, a cavity A12 adjacent to the shoulder A11 so that the second screw 40 may be used to secure the corner post A and the end of the top bar 22, the top bar 32, the bottom bar 23, or the bottom bar 33 together, a first inclined outer surface A13 adjacent to the cavity A12, a first vertical channel A17 defined by the first inclined outer surface A13, the shoulder A11 and the cavity A12, a first flat outer surface A14 extending from the first inclined outer surface A13 and parallel to the first inner surface A1, a second inclined outer surface A15 extending from the first flat outer surface A14, a second vertical channel A16 defined by the second inclined outer surface A15, the first flat outer surface A14, the first inclined outer surface A13, the cavity A12, the shoulder A11, the first inner surface A1, and the C-shaped groove A21, a second flat outer surface A24 extending from the second inclined outer surface A15 and parallel to the second inner surface A2, a third inclined outer surface A23 interconnecting the second flat outer surface A24 and the second inner surface A2, and a third vertical channel A25 defined by the second inclined outer surface A15, the second flat outer surface A24, the third inclined outer surface A23, the second inner surface A2, and the C-shaped groove A21. As an end, the four corners of the containing structure 10 of the cabinet 1 are protected by a cushioning arrangement.

While the invention has been described in terms of preferred embodiments, those skilled in the art will recognize that the invention can be practiced with modifications within the spirit and scope of the appended claims.

What is claimed is:

1. A cabinet, comprising:

a containing structure including a plurality of drawers, a first front corner post, a second front corner post, a rear panel, a first side panel, and a second side panel;

a first side frame secured to the first side panel and including first and second hollow corner posts attached to the first front corner post and the rear panel respectively, a top bar interconnecting upper portions of the first and second hollow corner posts and secured to the first side panel, a bottom bar interconnecting lower portions of the first and second hollow corner posts and secured to the first side panel, a board disposed between the first and second hollow corner posts, the top bar, and the bottom bar, and a push handle secured to both the top bar and the first side panel; and a second side frame secured to the second side panel and including first and second hollow corner post members attached to the second front corner post and the rear panel respectively, a top bar member interconnecting upper portions of the first and second hollow corner post members and secured to the second side panel, a bottom bar member interconnecting lower portions of the first and second hollow corner post members and secured to the second side panel, a rack secured to both the top bar member and the second side panel, a plurality of sets of two positioning members secured to the first and second hollow corner post members respectively, and a plurality of baskets secured to the sets of the positioning members respectively;

wherein each of the first and second hollow corner posts or each of the first and second hollow corner post members includes a first inner surface abutted on one of the first and second side panels, a second inner surface perpendicular to the first inner surface and abutted on either one of the first and second front corner posts or the rear panel, a groove at a joining portion of the first inner surface and the second inner surface and complimentarily engaged with one of four corners of the containing structure, a shoulder at an end of the first inner surface distal the groove and engaged with an end of the top bar, an end of the top bar member, an end of the bottom bar, or an end of the bottom bar member, a cavity adjacent to the shoulder, a first inclined outer surface adjacent to the cavity, a first vertical channel defined by the first inclined outer surface, the shoulder, and the cavity, a first flat outer surface extending from the first inclined outer surface and parallel to the first inner surface, a second inclined outer surface extending from the first flat outer surface, a second vertical channel defined by the second inclined outer surface, the first flat outer surface, the first inclined outer surface, the cavity, the shoulder, the first inner surface, and the groove, a second flat outer surface extending from the second inclined outer surface and parallel to the second inner surface, a third inclined outer surface interconnecting the second flat outer surface and the second inner surface, and a third vertical channel defined by the second inclined outer surface, the second flat outer surface, the third inclined outer surface, the second inner surface, and the groove;

wherein the first and second hollow corner posts are configured to fasten the top and bottom bars together at the cavities using fasteners; and wherein the first and second hollow corner post members are configured to fasten the top and bottom bar members together at the cavities using fasteners.

* * * * *